United States Patent [19]

Solheim et al.

[11] Patent Number: 4,805,784

[45] Date of Patent: Feb. 21, 1989

[54] SLATWALL MOUNTING DEVICE

[75] Inventors: John A. Solheim, Phoenix; Gary E. Keller, Mesa, both of Ariz.

[73] Assignee: Karsten Manufacturing Corporation, Phoenix, Ariz.

[21] Appl. No.: 143,669

[22] Filed: Jan. 14, 1988

[51] Int. Cl.[4] ..... A47F 5/08

[52] U.S. Cl. ..... 211/94; 211/59.1

[58] Field of Search ..... 211/94, 54.1, 57.1, 211/59.1, 94.5, 162, 16, 125; 248/222.3, 223.4, 243; 24/590, 591, 594, 593

[56] References Cited

U.S. PATENT DOCUMENTS

| | | | |
|---|---|---|---|
| 4,452,360 | 6/1984 | Barnes | 211/59.1 |
| 4,572,381 | 2/1986 | Brealey et al. | 248/223.4 |
| 4,598,504 | 7/1986 | Itagaki | 248/243 X |

FOREIGN PATENT DOCUMENTS

| | | | |
|---|---|---|---|
| 924232 | 1/1955 | Fed. Rep. of Germany | 211/94 |

*Primary Examiner*—Alvin C. Chin-Shue

*Assistant Examiner*—Sarah A. Lechok Eley

*Attorney, Agent, or Firm*—Herbert E. Haynes, Jr.

[57] ABSTRACT

A mounting device for displaying items on slatwall having grooves of T-shaped cross section formed therein. The mounting device comprises a base having a pin projecting rearwardly therefrom for extending through the open throat of the T-groove of the slatwall. The distal end of the pin has a transverse cross bar thereon which is aligned with the open throat of the T-groove and moved therethrough into the channel portion of the groove when the device is being mounted on the slatwall, and then the entire device is then rotated about its longitudinal axis to turn the cross bar into a transverse position relative to the channel. The cross bar of the mounting device is of special configuration so that a wedging action occurs when the device is rotated to move the cross bar into it's transverse position which firmly and demountably attaches the device to the slatwall. A support fixture is interchangeably carried by the base of the mounting device for supporting various articles to be displayed on the slatwall.

18 Claims, 1 Drawing Sheet

SLATWALL MOUNTING DEVICE

BACKGROUND OF THE INVENTION

1. Field of the Invention

This invention relates in general to mounting fixtures and, more particularly, to a mounting device for supporting articles to be displayed on a wall structure of the type commonly referred to as a "slatwall", which is provided with elongated horizontally extending T-grooves.

2. Description of the Prior Art

Merchants, retail establishments and the like, frequently employ special display wall structures of the type generally known as "slatwalls" for displaying their products to customers. As is well known, a slatwall is a wall panel formed of pressed board or other suitable material into which a plurality of regularly spaced, horizontally extending grooves of T-shaped cross section have been formed. Various different display mounting accessories such as brackets, shelves, baskets and the like are available which are specially designed for fitting into the T-grooves of the slatwall so that display items can be conveniently hung or otherwise supported thereon.

A typical type of prior art slatwall display mounting accessory consists of a cantilever element of some kind which projects normally from a flat base plate. The top edge of the base plate is bent rearwardly to define a corner portion, and the rear edge of this corner portion is turned upwardly to form a mounting flange. When the accessory is installed in a slatwall, the base plate bears against the front surface of the slatwall and the mounting flange of the base plate extends in a hooked-fashion so as to bear against the inner surface of the upper one of the ledges, which, in conjunction with a similar lower ledge, defines the reduced width open throat portion of the T-grooves of the slatwall panel.

The aforementioned prior art type of slatwall display mounting accessory suffers from a number of drawbacks. A first drawback is that the design of the mounting flange does not firmly mount the accessory in the groove and does not provide a uniform distribution of load weight within the internal groove surfaces of the slatwall. As a result, bending stresses tend to be concentrated on the upper ledge of the T-groove, which decreases the overall hanging strength of the wall. It is possible to compensate for the reduced strength of the slatwall by fitting and permanently bonding rigid extruded vinyl or aluminum inserts into the T-grooves. However, the cost of such inserts make them uneconomical for most establishments. A second drawback results from a portion of the hanging load being borne by the base plate which, as mentioned above, bears on the front surface of the slatwall. This produces denting, scratching, and other disfigurement of the slatwall which is highly undesirable in displaying merchandise. A third drawback of this prior art accessory is that although the mounting flange prevents the accessory from being pulled axially out of the wall, the accessory is free to slide laterally within the groove. Such sliding movement may be desirable at times, such as when the retailer wants to reposition display items for different visual effects, but it is not desirable at other times such as when the display items are accidentally brushed against or otherwise struck from one side.

Therefore, a need exists for a new and improved slatwall mounting device which overcomes some of the shortcomings and difficulties of the prior art.

SUMMARY OF THE INVENTION

In accordance with the present invention, a new and improved mounting device is disclosed for demountable attachment to a slatwall, with the mounting device being adapted to support various items such as retail merchandise that is to be displayed ont he slatwall.

As is well known in the art, a slatwall is a panel-like structure formed of pressed wood or other suitable material, with a plurality of horizontally extending vertically spaced grooves cut or otherwise formed therein. Each of the grooves is of T-shaped cross section to provide an elongated inner channel having an elongated reduced width throat which extends normally from the midpoint of the channel and opens onto the front face of the slatwall panel.

The mounting device includes a base means defining a flat rear surface with a pin extending normally from the flat surface and having a cross bar of special configuration transversely disposed on the extending rear end of the pin. The transverse cross bar has a width dimension which is slightly less than the width of the open throat of the T-groove and has a length dimension which is slightly less than the transverse dimension of the channel portion of the T-groove. Therefore, by positioning the cross bar of the mounting device so that it is longitudinally aligned with the throat of the T-groove, the device can be moved axially into the groove to position the cross bar in the inner channel of the T-groove. When partially installed in this manner, the installer rotates the device about the longitudinal axis of the pin thereof, through a rotational angle of about 90° which turns the cross bar in the channel to a transverse position relative to the longitudinal extent of the channel behind the ledges which define the top and bottom of the throat of the T-groove of the slatwall.

A relatively small conical projection is provided on the back surface of the transverse cross bar of the mounting device so as to extend normally from the center of that cross bar surface. The thickness dimension of the cross bar added to the extending length of the conical projection is slightly greater than the depth dimension of the channel portion of the T-groove. Therefore, when the installer rotates the device to complete its mounting as described above, cam surface means provided on the transverse cross bar produces a wedging action that occurs when the cross bar is being rotated into the transverse mounted position in the channel of the T-groove. The wedging action causes the conical projection to be driven into the forwardly facing back surface of the T-groove, and this results in a reaction which moves the opposite surface of the transverse cross bar into firm bearing engagement with the inwardly facing surfaces of the channel which are provided by the ledges that are above and below the open inner end of the throat portion of the T-groove. The wedging action firmly anchors the device in the T-groove of the slatwall so that it cannot be axially withdrawn or laterally moved in the absence of a dismounting operation that must be accomplished by reversal of the above-described mounting operation.

A fixture means extends from the base means of the mounting device in a direction which is opposite to the flat rear surface of the base means. The fixture means is adapted to support whatever type of merchandise that is to be displayed on the slatwall and the mounting device is preferably configured for interchangeably carrying various types of fixture means. However, a preferred type of fixture means is disclosed in the form of a tapered rod having a blind bore formed in its smaller end for receiving a peg, that is provided on the base means for that purpose, in a demountable press-fit. The distal end of the rod has an enlarged rim which acts as a stop for preventing items supported thereby from accidentally sliding off or being pulled or knocked from the rod.

Accordingly, it is an object of this invention to provide a new and improved mounting device for attachment to a slatwall for supporting articles that are to be displayed on the slatwall.

Another object of the present invention is to provide a new and improved mounting device which is firmly and demountably mounted in the T-shaped grooves of a slatwall in a manner wherein the load applied by articles supportable thereon is evenly distributed on the internal surfaces of the grooves of the slatwall.

Another object of the present invention is to provide a new and improved slatwall mounting device of the above described character with means for firmly and demountably anchoring the device in the T-grooves of the slatwall to prevent axial withdrawal and lateral sliding of the device in the T-groove of the slatwall.

Still another object of the present invention is to provide a new and improved slatwall mounting device of the above type and having a fixture means extending therefrom for supporting the various types of articles that are to be displayed on the slatwall.

The foregoing and other objects of the present invention, as well as the invention itself, may be more fully understood from the following description when read in conjunction with the accompanying drawings.

DESCRIPTION OF THE PREFERRED EMBODIMENT

Figure 1:
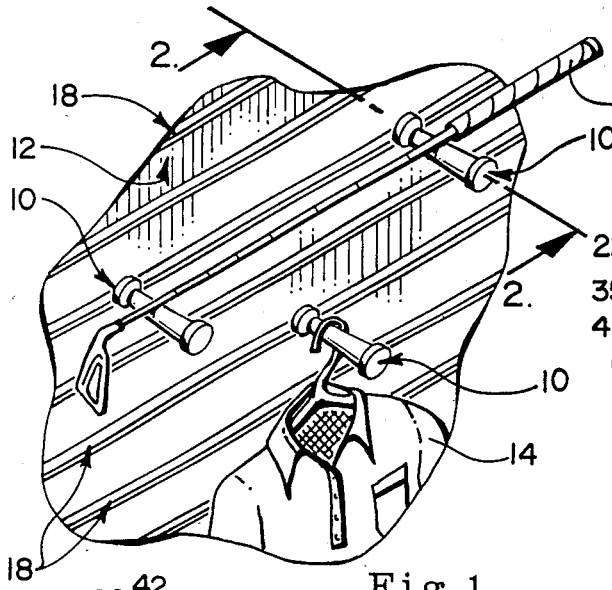
FIG. 1 is a perspective view showing a number of the mounting devices of the present invention being used to display items on a slatwall.
Figure 4:
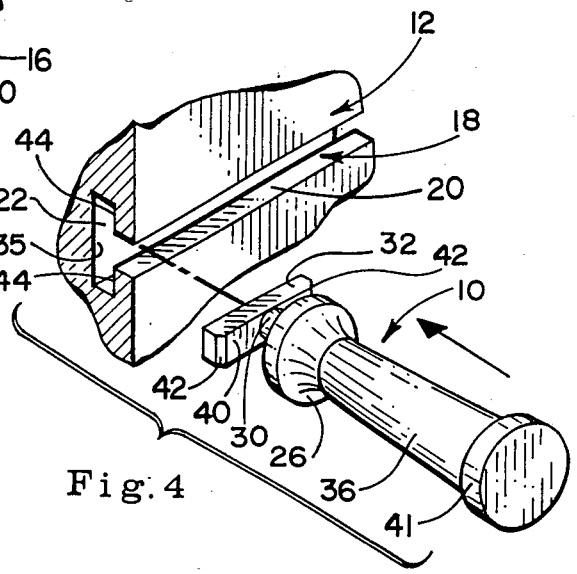
FIG. 4 is a perspective view showing the mounting device in exploded relationship to a T-groove in a slatwall.

Referring more particularly to the drawings, FIG. 1 shows a number of the mounting devices of the present invention, each indicated in its entirety by the numeral 10, mounted in a conventional slatwall 12 for displaying various items such as article of clothing 14, a golf club 16 or any other merchandise.

As is generally well known, the slatwall 12 consists of one or more panels of pressed board or a similar material into which a plurality of regularly spaced, horizontally extending elongated grooves 18 of T-shaped cross section have been carved or otherwise formed. The cross-section of each T-groove defines a relatively narrow elongated open throat, or stem portion 20 which opens forwardly to the front surface of the slatwall panel 12, and an elongated inner channel portion 22 which transversely intersects the rear end of the open throat 20.

Figure 2:
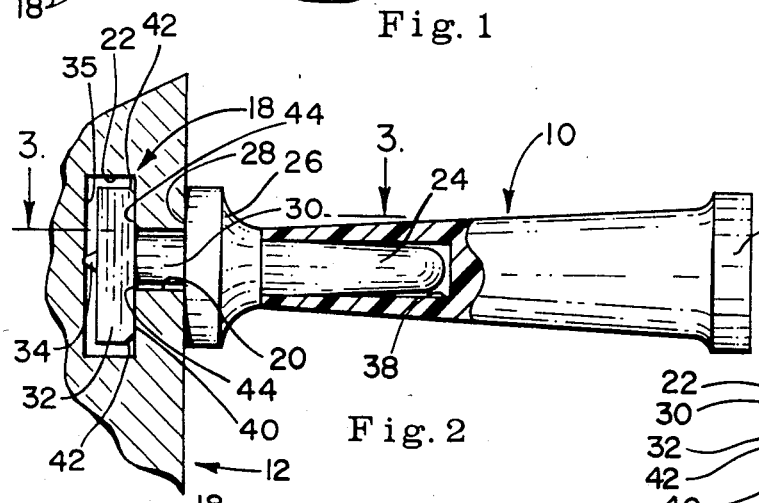
FIG. 2 is an enlarged sectional view taken through line 2—2 of FIG. 1.
Figure 5:
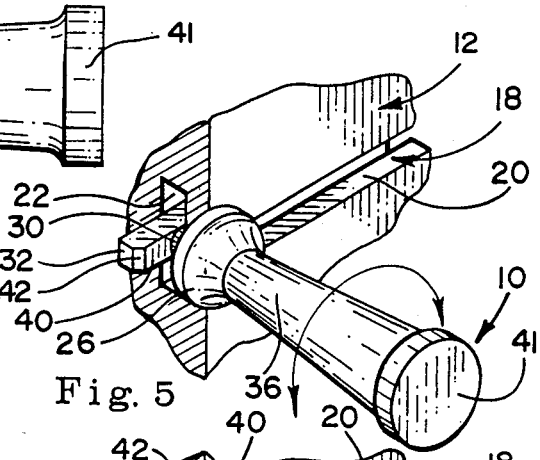
FIG. 5 is a perspective view showing the mounting device in a partially installed but unfastened position in a slatwall T-groove.
Figure 3:
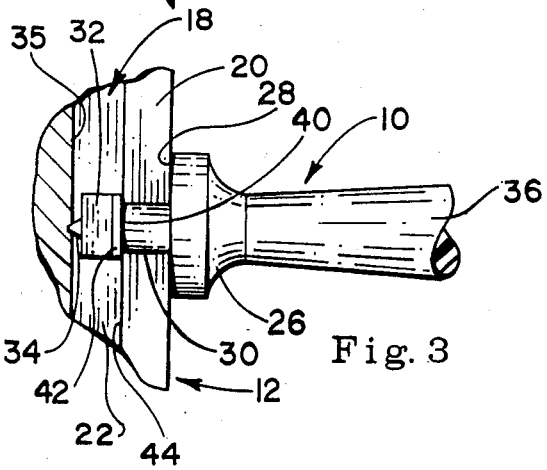
FIG. 3 is an enlarged sectional view taken through line 3—3 of FIG. 2.
Figure 6:
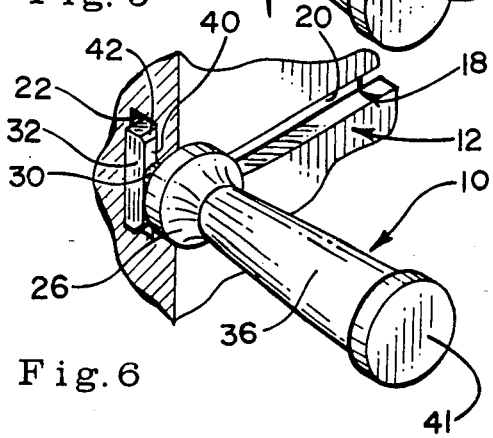
FIG. 6 is a perspective view showing the mounting device in a completely installed and fastened position in the T-groove of the slatwall.

As is best seen in FIG. 2, the mounting device comprises a peg means 24 having an enlarged base means 26 which defines a flat rear surface 28 on the side thereof which is opposite to the peg means 24. The flat surface 28 of the base spans the width of the open throat portion 20 of the T-groove 18, and faces the front surface of the slatwall paneling 12 both above and below open throat 20 of the T-groove 18 when the device 10 is mounted therein. A pin 30, preferably of cylindrical configuration, extends axially and rearwardly from the rear surface 28 of the base means 26, for extending through the open throat portion 20 of the T-groove. The rearmost end of the pin 30 is connected perpendicularly to the mid-point of a cross bar 32 which is slightly narrower in width then the open throat portion 20 of the T-groove 18, and shorter in length than the transverse dimension of the channel portion 22 of the T-groove 18. A small conical projection 34 is formed on the back surface of the cross bar 32 for interacting with the cross bar 32 and the internal surfaces of the T-groove 18 to firmly mount and prevent the mounting device 10 from sliding laterally in the groove.

A support fixture of any configuration such as a rod, bracket, hook or the like may be demountably carried in a suitable fashion by the peg member 24 of the mounting device 10. In the preferred embodiment of the invention, however, the support fixture comprises a tapered rod 36 having a blind bore 38 formed in its smaller end for receiving the free end of the peg member 24 in a press-fit. The distal end of the rod 36 has an enlarged rim 41 which acts as a stop for preventing items displayed thereon from accidentally being pulled or knocked from the rod 36.

The procedure for installing the device 10 in the slatwall 12 is illustrated in FIGS. 3–6. First, it is necessary to longitudinally align the cross bar 32 of the device 10 with the front opening defined by the open throat portion 20 of the T-groove 18 and move the cross bar 32 into the channel portion 22 thereof. Once the conical projection 34 of the cross bar 32 touches the back internal surface 35 of the groove, the installer twists the device 10 through an angle of approximately 90° about the longitudinal axis of the cylindrical pin 30 so that the cross bar 32 is rotated so as to extend in the transverse direction relative to longitudinal extent of the channel member 22 of the T-groove 18.

As shown, the combined width dimension of the cross bar 32 and the length of it's conical projection 34 is greater than the depth of the transverse channel portion 22 of the T-groove 18. Therefore, the forwardly facing bearing surface 40 of the cross bar 32 has cam surface means in the form of beveled ends as at 42 so that when the mounting device is being twisted for mounting purposes, the beveled ends 42 will serve as wedges which drive the conical projection 34 into rear internal surface 35 of the transverse channel portion 22 of the T-groove. As the concial projection 34 is driven into the back surface of the channel 22, a reaction takes place which moves the bearing surface 40 of the cross bar 32 into firm engagement with the inwardly facing internal surfaces 44 of the channel 22 which are located above and below the inner open end of the open throat 20. Due to the tapered configuration of the conical projection 34, penetration into the back surface 35 of the channel 22 will occur only to the extent required to accomplish the firm engagement of the bearing surface 40 of the cross bar 32 with the internal surfaces 44 of the channel 22. This will, therefore, compensate for wear, manufacturing tolerances of the groove 18, and in all cases, except possible excessive wear and/or tolerance deviation, the flat surface 28 of the base means 26 will bear very lightly, if at all on the front surface of the slatwall panel 12, and the weight load exerted on the device 10 will be borne by the internal surfaces 44 of the groove 18. Once the mounting device 10 has been positioned in this way, the cross bar 32 is firmly retained between the front and rear internal surfaces of the T-groove 18, and the mounting device 10 cannot be withdrawn by an axial pulling force.

A single mounting device 10 thus installed may be used to hang items such as the clothing 14, as shown in the bottom portion of FIG. 1 or, alternatively, two or more of the devices 10 may be positioned in spaced apart, side-by-side relationship to support opposite ends of elongated items such as the golf clubs 16, as shown in the top portion of FIG. 1. When removal or repositioning of a mounting device 10 is desired, it is simply necessary to twist the device another 90° about the longitudinal axis of the cylindrical pin 30, so that the cross bar 32 is once again longitudinally aligned with the open throat portion 20 of the T-groove 18, and can be easily withdrawn therefrom.

While the principles of the invention have now been made clear in the illustrated embodiments, there will be immediately obvious to those skilled in the art, many modifications of structure, arrangements, proportions, the elements, materials and components used in the practice of the invention and otherwise, which are particularly adapted for specific environments and operation requirements without departing from those principls. The appended claims are therefore intended to cover and embrace any such modifications within the limits only of the true spirit and scope of the invention.

What I claim is:

1. A display mounting device for demountable use with a slatwall of the type having at least one elongated groove formed therein which is of T-shape cross section to define an elongated inner channel with an elongated relatively narrow throat portion extending from the midpoint of the channel so as to open onto the front face of the slatwall, the channel portion of the groove having an outwardly facing bottom surface and an opposed pair of inwardly facing front surfaces that are located above and below the open throat portion of the groove of the slatwall, said display mounting device comprising:

(a) base means having a flat surface which faces the front surface of the slatwall in spanning overlaying relationship with the forwardly open end of the open throat portion of the groove of the slatwall when said mounting device is mounted on the slatwall;

(b) pin means extending normally from the flat surface of said base means for extending through the open throat portion of the groove of the slatwall, said pin means defining a longitudinal axis;

(c) a transverse cross bar means on the extending end of said pin means for aligned movement through the open throat portion into the channel portion of the groove of the slatwall;

(d) said base means, said pin means and said cross bar means being rotatable as an entity about the longitudinal axis of said pin means for rotating said cross bar means in the channel of the groove of the slatwall between longitudinally aligned and transversely disposed positions therein;

(e) means extending from said base means in a direction opposite to the flat surface thereof for supporting merchandise to be displayed; and (f) means on said cross bar for interacting with the slatwall to prevent lateral sliding movements of said display mounting device in the elongated groove of the slatwall.

2. A display mounting device as claimed in claim 1 wherein said means for preventing lateral sliding movements comprises a projection means which extends from said cross bar for penetration into the outwardly facing surface of the channel of the groove of the slatwall when said cross bar is rotated into it's transverse position in the groove of the slatwall.

3. A display mounting device as claimed in claim 1 and further comprising said cross bar having a first surface which faces the outwardly facing bottom surface of the channel portion of the groove of the slatwall when mounted therein and having a second oppositely facing bearing surface which engages the inwardly facing front surfaces of the channel of the groove of the slatwall when said cross bar has been rotated into its transverse position in the groove of the slatwall.

4. A display mounting device as claimed in claim 3 and further comprising:

(a) projection means extending normally from the midpoint of the first surface of said cross bar;

(b) said cross bar having a width dimension which in conjunction with the extending length of said projection means is greater than the depth dimension of the channel portion of the groove of the slatwall; and (c) cam surface means at each of the opposite ends of the bearing surface of said cross bar which produce a wedging action to drive said projection means into the outwardly facing bottom surface of the channel portion of the groove of the slatwall and produce a reaction which moves the bearing surface of said cross bar into firm engagement with the inwardly facing front surfaces of the channel of the groove of the slatwall when said cross bar is rotated into it's transverse position therein.

5. A display mounting device as claimed in claim 4 wherein the opposite ends of the bearing surface of said cross bar are beveled to provide said cam surface means.

6. A display mounting device as claimed in claim 4 wherein said projection means is of conical configuration.

7. A display mounting device as claimed in claim 1 wherein said means for supporting merchandise to be displayed comprises:

(a) a peg extending from said base means in a direction opposite with respect to said pin means; and (b) a support fixture means demountably carried on said peg.

8. A display mounting device as claimed in claim 7 wherein said support fixture means has a blind bore formed therein in which said peg is received in a press-fit.

9. A display mounting device as claimed in claim 7 wherein said support fixture means comprises an elongated tapered rod having a small end and a larger distal end, said small end defining a blind bore in which said peg is received and forms a press-fit therein, said distal end having an enlarged rim for preventing merchandise to be displayed from accidentally being pulled off said rod.

10. A display mounting device in combination with a slatwall structure comprising:

(a) a slatwall having at least one horizontally extending groove formed therein of T-shaped cross section to provide an elongated inner channel with an elongated relatively narrower throat portion which extends normally from the midpoint of the channel and opens onto the front surface of said slatwall, the channel portion of the groove having an outwardly facing bottom surface and an opposed pair of inwardly facing front surfaces that are located above and blow the open throat portion of the groove of said slatwall;

(b) base means having a flat surface which faces the front surface of said slatwall in spanning overlaying relationship with the forwardly opening end of the open throat portion of the groove of said slatwall;

(c) pin means extending normally from the flat surface of said base means through the open throat portion of the groove of said slatwall, said pin means defining a longitudinal axis;

(d) a cross bar means formed transversely on the extending end of said pin means and disposed in the channel portion of the groove of said slatwall, said cross bar having a width dimension which is slightly smaller than the width of the open throat portion of the groove of said slatwall and a length dimension which is slightly shorter than the transverse width of the channel portion of the groove of said slatwall;

(e) said base means, said pin means and said cross bar means being rotatable as an entity about the longitudinal axis of said pin means for aligning said cross bar with the open throat portion of the groove of said slatwall for movement therethrough and for rotating said cross bar between longitudinally aligned and transversely disposed positions in the channel portion of the groove of said slatwall; and (f) means extending from said base means in a direction opposite of said pin means for supporting items to be displayed; and (g) means on said crossbar for interacting with said slatwall to prevent lateral sliding movements of said display mounting device in the elongated groove os said slatwall.

11. A display mounting device as claimed in claim 10 wherein said means for preventing lateral sliding movements comprises a projection means which extends from said cross bar for penetration into the outwardly facing bottom surface of the channel of the groove of said slatwall when said cross bar is rotated into it's transverse position in the groove of said slatwall.

12. A display mounting device as claimed in claim 10 and further comprising said cross bar having a first surface which faces the outwardly facing bottom surface of the channel portion of the groove of said slatwall and having a second oppositely facing bearing surface which engages the inwardly facing front surfaces of the channel of the groove of said slatwall when said cross bar is in its transverse position in the groove of said slatwall.

13. A display mounting device as claimed in claim 12 and further comprising:

(a) projection means extending normally from the midpoint of the first surface of said cross bar;

(b) said cross bar having a width dimension which in conjunction with the extending length of said projection means is greater than the depth dimension of the channel portion of the groove of said slatwall; and (c) cam surface means at each of the opposite ends of the bearing surface of said cross bar which produce a wedging action to drive said projection means into the bottom surface of the channel portion of the groove of said slatwall to produce a reaction which moves the bearing surface of said cross bar into firm engagement with the inwardly facing front surfaces of the channel of said slatwall when said cross bar is rotated into it's transverse position therein.

14. A display mounting device as claimed in claim 13 wherein the opposite ends of the bearing surface of said cross bar are beveled to provide said cam surface means.

15. A display mounting device as claimed in claim 13 wherein said projection means is of conical configuration.

16. A display mounting device as claimed in claim 10 wherein said means for supporting merchandise to be displayed comprises:

(a) a peg extending from said base means in a direction opposite with respect to said pin means; and (b) a support fixture means demountably carried on said peg.

17. A display mounting device as claimed in claim 16 wherein said support fixture means has a blind bore formed therein in which said peg is received in a press-fit.

18. A display mounting device as claimed in claim 16 wherein said support fixture means comprises an elongated tapered rod having a small end and a larger distal end, said small end defining a blind bore in which said peg is received and forms a press-fit therein, said distal end having an enlarged rim for preventing merchandise to be displayed from accidentally being pulled off said rod.

* * * * *